US008439485B2

(12) United States Patent
Tamaru et al.

(10) Patent No.: US 8,439,485 B2
(45) Date of Patent: May 14, 2013

(54) SUBSTRATE INCLUDING A DETECTION FEATURE FOR LIQUID DISCHARGE HEAD AND LIQUID DISCHARGE HEAD

(75) Inventors: Yuji Tamaru, Yokohama (JP); Yoshiyuki Imanaka, Kawasaki (JP); Koichi Omata, Kawasaki (JP); Hideo Tamura, Kawasaki (JP); Kousuke Kubo, Kawasaki (JP); Ryoji Oohashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 82 days.

(21) Appl. No.: 13/112,877

(22) Filed: May 20, 2011

(65) Prior Publication Data

US 2011/0310183 A1 Dec. 22, 2011

(30) Foreign Application Priority Data

Jun. 18, 2010 (JP) ..... 2010-139956

(51) Int. Cl.
*B41J 2/05* (2006.01)

(52) U.S. Cl.
USPC ..... 347/65; 347/50; 347/58

(58) Field of Classification Search ..... 347/50, 347/56–59, 62–65, 67
See application file for complete search history.

(56) References Cited

U.S. PATENT DOCUMENTS 7,909,423 B2 * 3/2011 Saikawa et al. ..... 347/17

FOREIGN PATENT DOCUMENTS

JP 11-334075 A 12/1999

* cited by examiner

*Primary Examiner* — Juanita D Jackson
(74) *Attorney, Agent, or Firm* — Canon USA Inc IP Division

(57) ABSTRACT

A liquid discharge head includes a heat accumulation layer provided on a board, an energy generation element configured to generate energy to discharge liquid from a discharge port and including a heat generation resistor layer provided on the heat accumulation layer and formed of a material configured to generate heat through supply of electricity and a pair of electrodes connected to the heat generation resistor layer, and an insulation layer including a silicon compound and provided so as to cover the energy generation element, and a line formed of a metal material provided between the heat accumulation layer and the insulation layer, and in at least a portion at a position closer to a flow path than the energy generation element.

20 Claims, 17 Drawing Sheets

SUBSTRATE INCLUDING A DETECTION FEATURE FOR LIQUID DISCHARGE HEAD AND LIQUID DISCHARGE HEAD

BACKGROUND OF THE INVENTION

1. Field of the Invention

The present invention relates to a substrate for a liquid discharge head and to a liquid discharge head.

2. Description of the Related Art

A liquid discharge head has a liquid discharge head substrate having on a silicon board an energy generation element configured to generate energy used to discharge liquid, and a flow path wall member forming the wall of a discharge port and of a flow path, and constructed by bonding thereof to the liquid discharge head substrate.

The energy generation element as mentioned above is formed by a heat generation resistor layer consisting of a heat generation material configured to generate heat through supply of electricity and by a pair of electrodes provided so as to be in contact with the heat generation resistor layer, and is covered with an insulation layer for protection from liquid. By applying voltage between the pair of electrodes, the heat generation resistor layer, disposed between the pair of electrodes, generates heat. Through this heat generation, the liquid causes film boiling to bubble, and is discharged through the discharge port by the pressure of a bubble generated at this time, whereby recording operation is performed.

It is known that, to protect the insulation layer, a protective layer having an anti-cavitation property consisting of a metal material or the like is provided on the insulation layer. As discussed in Japanese Patent Application Laid-Open No. 11-334075, an insulation layer consisting of a silicon compound is provided on the energy generation element, and a protective layer consisting of tantalum is provided thereon.

However, in recent years, to achieve an improvement of recording image quality and durability, a solvent of high degree of solubility is used as the liquid to be discharged, so that, depending on the kinds and concentrations of the components of the liquid to be discharged, the silicon layer consisting of a silicon compound may be dissolved, resulting in exposure of the electrodes to allow the liquid to be brought into contact with the electrodes.

Then, electric current will flow through a portion where it is not expected to flow, resulting in an unstable recording operation. It might be possible to cope with this problem by changing the material and thickness of the insulation layer. In reality, however, that would be very difficult when considering the characteristics related to the discharge performance, such as heat conductivity from the energy generation element to the liquid.

SUMMARY OF THE INVENTION

According to an aspect of the present invention, a liquid discharge head includes a liquid discharge head substrate having a board equipped with a supply port extending therethrough to supply liquid, a heat accumulation layer consisting of a silicon compound provided on the board, an energy generation element which is configured to generate energy to discharge liquid from a discharge port and which is composed of a heat generation resistor layer provided on the heat accumulation layer and formed of a material configured to generate heat through supply of electricity and a pair of electrodes connected to the heat generation resistor layer, and an insulation layer consisting of a silicon compound and provided so as to cover the energy generation element, and a flow path wall member having a wall of a flow path establishing communication between the discharge port and the supply port and configured to form the flow path by being brought into contact with the liquid discharge head substrate, wherein there is provided, between the heat accumulation layer and the insulation layer, and in at least a portion at a position closer to the flow path than the pair of electrodes, a line formed of a metal material and electrically connected to a terminal provided on the board.

With this arrangement, it is possible to detect the liquid before it reaches the energy generation element.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A liquid discharge head can be mounted in an apparatus such as a printer, a copying machine, a facsimile machine with a communication system, or a word processor with a printer unit. Further, it can be mounted in an industrial recording apparatus combined with various processing apparatuses.

And, by using this liquid discharge head, it is possible to perform recording on a recording medium such as paper, thread, fiber, cloth, leather, metal, plastic, glass, wood, or ceramic.

In the present specification, the term "recording" means not only imparting to a recording medium an image with meanings such as characters and figures but also imparting an image with no meaning such as a pattern.

Figure 1A:
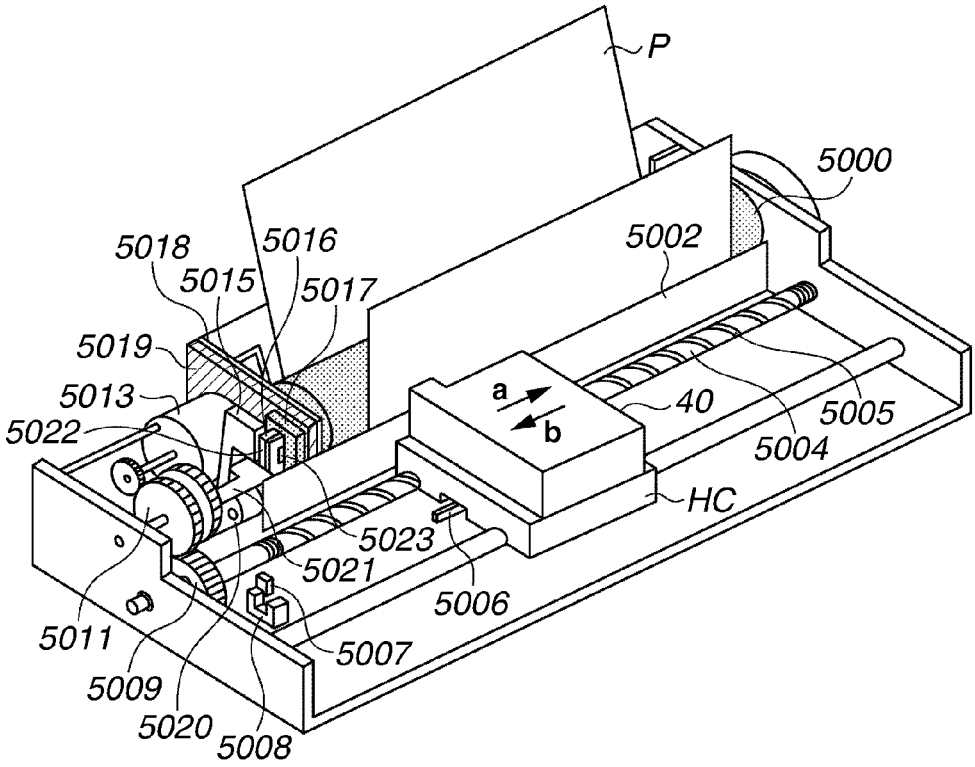
FIGS. 1A and 1B illustrate an example of a liquid discharge apparatus and a head unit to which a liquid discharge head according to the present invention is applicable.

FIG. 1A is a schematic diagram illustrating an example of a liquid discharge apparatus in which a liquid discharge head according to an exemplary embodiment of the present invention can be mounted.

As illustrated in FIG. 1A, a lead screw 5004 is rotated via driving force transmission gears 5011 and 5009 in conjunction with normal and reverse rotations of a driving motor 5013. A carriage HC allows mounting of a head unit and has a pin engaged with a spiral groove 5005 of the lead screw 5004, and a head unit 40 can reciprocate in the directions of the arrows a and b through the rotation of the lead screw 5004.

A sheet holding plate 5002 presses a recording sheet P against a platen 5000 over the length through which the carriage HC moves. Photo sensors 5007 and 5008 are home position sensors for switching the rotating direction of the motor 5013 through detection of a lever 5006 of the carriage HC.

A cap 5022 hermetically covering the front surface of the head unit 40 is supported by a support member 5016. A suction member 5015 configured to perform suction on the interior of the cap 5022 can perform suction recovery on the head unit 40 through an opening 5023 in the cap. A cleaning blade 5017 and a member 5019 capable of moving the cleaning blade 5017 backward and forward are supported by a main body support plate 5018.

Figure 1B:
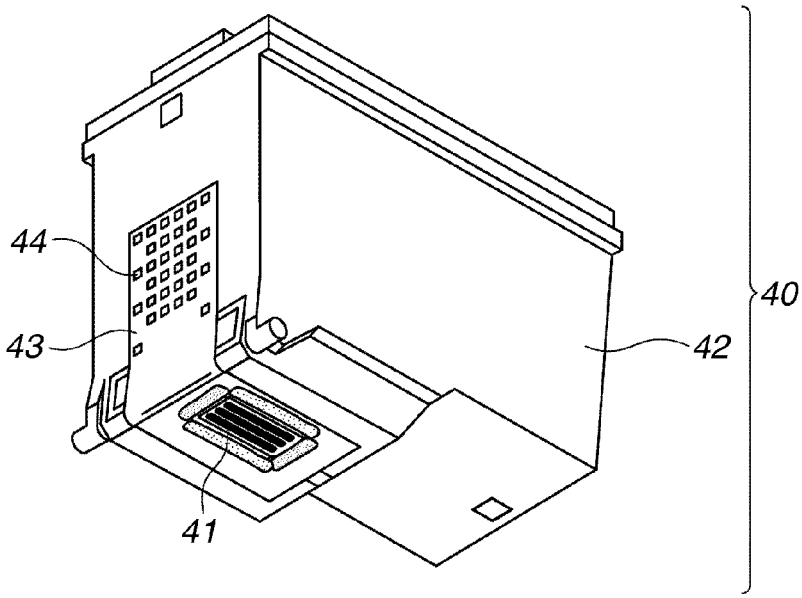

FIG. 1B is a perspective view of the head unit 40, which is equipped with a liquid discharge head 41 and can be detachably attached to a liquid recording apparatus (discharge apparatus).

The liquid discharge head 41 (hereinafter also referred to as the head) is connected to the liquid recording apparatus by a flexible circuit board 43 connected to connection terminals 7 and is electrically conductive with a contact pad 44. The head 41 is supported on the head unit 40 by being bonded to a support board. Although in this example the head unit 40 is integrated with an ink tank 42, it may also be of a separate type which allows separation of the ink tank.

By the connection of the contact pad 44 to the liquid recording apparatus, data signals, voltage, etc. for discharging liquid are supplied from the liquid recording apparatus to the head.

The "liquid" discharged in such a liquid discharge head is not limited to the ink used for recording operation, and it may also be a liquid to be used for forming images, patterns, etc., for processing the recording medium, or for processing the ink or the recording medium through applying thereof on the recording medium.

In recent years, to achieve an improvement in terms of fixing property with respect to the recording medium, of recording quality or coloring property, and of image durability, various dispersion materials and solvents are added to such a liquid. Depending on the material to be added, when the period of use is long or when in a high temperature environment, the insulation layer and the heat accumulation layer of the liquid discharge head, which are formed of a silicon compound, which is a material easy to be dissolved, may be dissolved.

When the insulation layer and the heat accumulation layer formed of a silicon compound are dissolved and the electrode layer is exposed, the liquid is brought into contact with the electrodes or the heat generation resistor layer, with the result that the electrode layer is corroded/dissolved or an electric current is allowed to flow through a portion where it is not expected to flow. Thus, there is a possibility of a malfunction during the recording operation or of the circuit, etc. of the liquid discharge apparatus being affected. In particular, it is known that a layer consisting of a silicon compound formed into a layer by using a chemical-vapor deposition (CVD) method notably is dissolved.

In the present invention, a detection line configured to cause a change in the flowing current value when brought into contact with liquid is provided on a side closer to the ink flow path than the electrodes. As a result, when the dissolution of the silicon material layers progresses, the detection line is exposed in the flow path prior to the electrodes and is brought into contact with the liquid.

This detection line is connected to the connection terminals 7 of the liquid discharge head 41, and a change in the current value between the connection terminals is detected by the liquid discharge apparatus or the like, whereby it is possible to stop the use of the liquid discharge head before the dissolution of the insulation layer by the liquid reaches the electrode layer.

In the following, the construction of the liquid discharge head provided with such a detection line will be illustrated specifically.

Figure 2A:
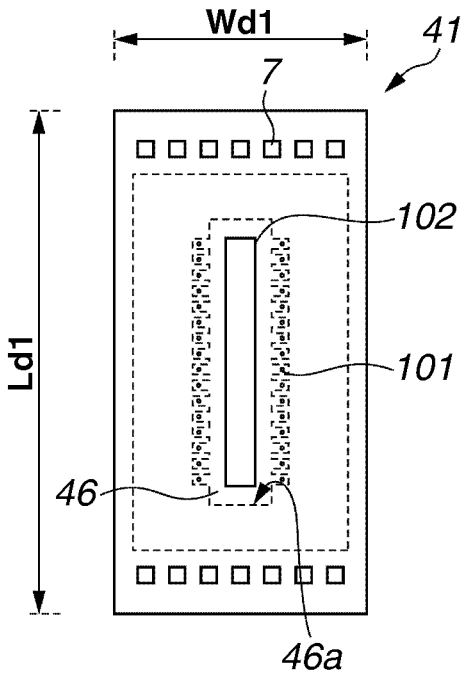
FIGS. 2A and 2B are schematic plan views of a liquid discharge head according to an exemplary embodiment of the present invention.
Figure 2B:
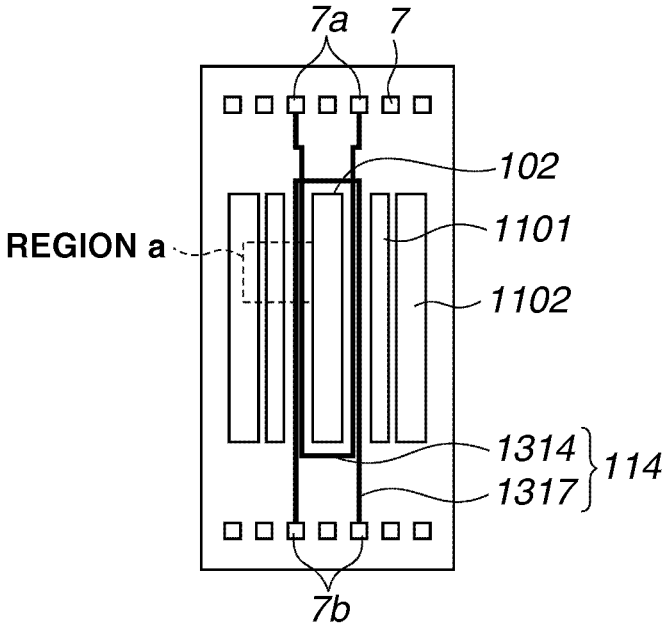

FIG. 2A is a plan view of the liquid discharge head 41 of a first exemplary embodiment, schematically illustrating a wall 46*a* of a flow path wall member 1310, discharge ports 101, an ink supply port 102, and the connection terminals 7. FIG. 2B schematically illustrates the detection lines 114 and the ink supply port 102 of the liquid discharge head 41 of FIG. 2A, element arrays 1101 in which a plurality of energy generation elements 111 are arranged, and driving element arrays 1102 consisting of a plurality of switching elements.

At the center of the liquid discharge head 41, there is provided the ink supply port 102 extending through a board formed of silicon to supply liquid. On both sides of the longer sides of the ink supply port 102, there are provided along the ink supply port 102 the element arrays consisting of a plurality of energy generation elements 111.

The discharge ports 101 are provided at opposing positions of the energy generation elements 111. The liquid discharge head 41 can be provided in, for example, a substrate width Wd1 of 2 mm and a substrate length Ld1 of 28 mm.

As a silicon substrate 1300, a silicon single crystal substrate of the (100) surface crystal orientation is used, whereby it is possible to provide the supply port 102 by crystal anisotropic etching using an alkali liquid (e.g., Tetramethylammonium hydroxide (TMAH) solution or potassium hydroxide (KOH) solution). In such a board, the etching rate of the (111) surface is very low as compared with the etching rate of the other surfaces, so that the angle the supply port 102 made with respect to the silicon substrate plane is approximately 54.7 degrees.

This (111) surface is resistant not only to the alkali solution but also to the liquid used for discharge, so that it is much difficult to be dissolved as compared with the insulation layer and the heat accumulation layer, which are formed of a silicon compound.

Figure 3A:
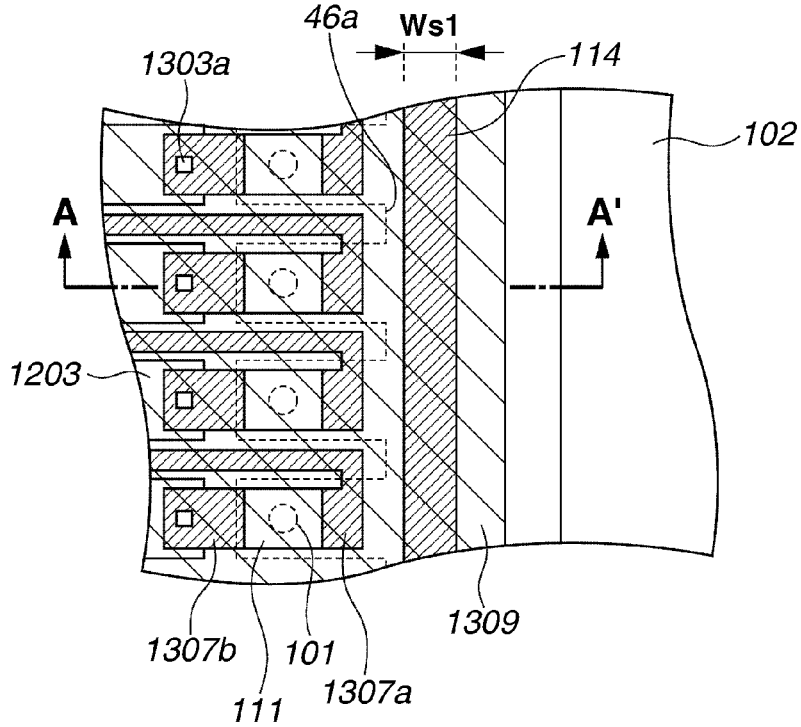
FIGS. 3A and 3B are a schematic plan view and a sectional view of a liquid discharge head according to an exemplary embodiment of the present invention.
Figure 3B:
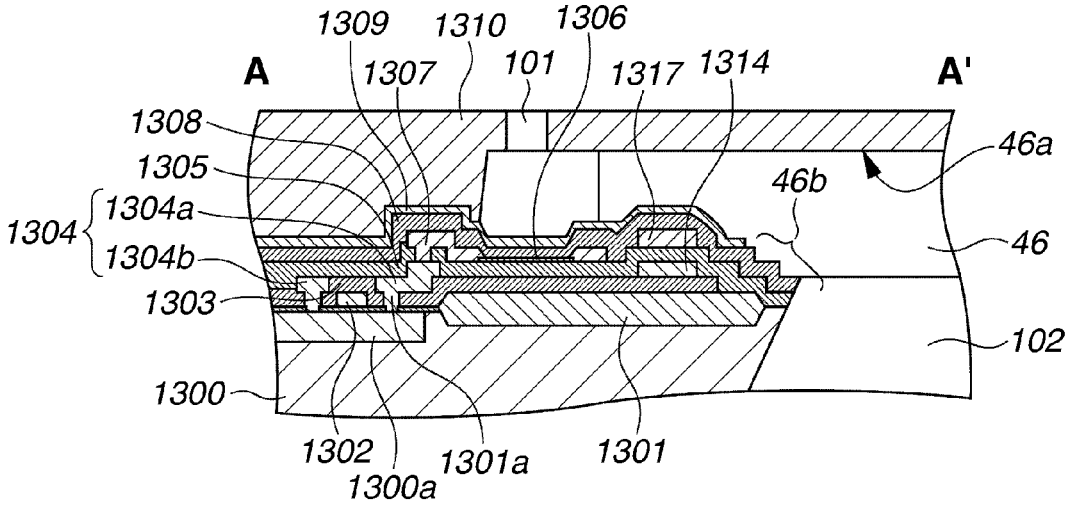

FIG. 3A is a partial enlarged view in which the region a in FIG. 2B is enlarged. FIG. 3B is a sectional view of FIG. 3A taken along the line A-A'. On the upper side with respect to the thickness direction of a board 1300 formed of silicon, there are provided a thermal oxidation layer 1301 formed through thermal oxidation of the board 1300, and a first heat accumulation layer 1303 (e.g., boron phosphorous silicon glass (BPSG)) consisting of a silicon compound formed by the CVD method or the like.

There is further provided thereon a second heat accumulation layer 1305 consisting of a silicon compound (e.g., P—SiO) formed by the CVD method or the like. On the second heat accumulation layer 1305, there are provided a heat generation resistor layer 1306 formed of a material (e.g., TaSiN) configured to generate heat through supply of electricity, and a pair of electrodes 1307 formed of a conductive material such as aluminum (e.g., Al—Cu) connected to the heat generation resistor layer 1306.

The first heat accumulation layer 1303 and the second heat accumulation layer 1305 are used also as insulation layers. The portion of the heat generation resistor layer 1306 between the pair of electrodes 1307 is used as the energy generation element 111.

To prevent corrosion by liquid, the heat generation resistor layer 1306 and the pair of electrodes are covered with an insulation layer 1308 (e.g., SiN) formed of an insulation material consisting of a silicon compound by using the CVD method. Further, to mitigate the influence of cavitation generated at the time of de-bubbling, there is provided on the insulation layer 1308 a protective layer 1309 (anti-cavitation layer) excellent in resistance to shock and ink.

As the material of the protective layer 1309, it is desirable to employ a metal material consisting of a refractory metal such as tantalum, iridium, or ruthenium, or a carbon material such as a carbon film (diamond-like carbon (DLC)) or a silicon carbide film (SiC). In this way, a liquid discharge head substrate 45 is provided.

One of the pair of electrodes 1307 (first electrode 1307*a*) is folded back on the ink supply port 102 side, and extends away from the ink supply port 102 in a direction substantially orthogonal to the extension of the longer side of the ink supply port 102. Further, the first electrode 1307*a* is connected to the connection terminals 7 and is used as a VH line (not illustrated).

The other of the pair of electrodes (second electrode 1307*b*) also extends away from the ink supply port in a direction substantially orthogonal to the extension of the longer side of the ink supply port 102. Further, the other electrode 1307*b* is connected to a drain electrode of a switching element 1203 (driving element) consisting of metal oxide semiconductor field-effect transistor (MOS-FET) or the like via a through-hole 1304*a* provided in the second heat accumulation layer 1305.

Referring to FIG. 3B, the switching element 1203 having MOS structure will be briefly described. The switching element 1203 is provided through connection of a gate electrode 1302 and logic electrodes 1304 (a source electrode and a drain electrode) to a transistor portion 1300*a* provided in the silicon board 1300.

The logic electrodes 1304, formed of a conductive material such as aluminum (e.g., Al—Si), are provided on the first heat accumulation layer 1303, and are covered with the second heat accumulation layer 1305. The drain electrode 1304*a* of the logic electrodes 1304 is connected to the second electrode 1307*b* via the through-hole of the second heat accumulation layer 1305.

The drain electrode 1304*a* is connected to the transistor portion 1300*a* via the through-hole of the thermal oxidation layer 1301 used as a gate insulation layer and the through-hole of the first heat accumulation layer 1303. The source electrode 1304*b* is connected to the connection terminals 7 via a GNDH line or the like (not illustrated) provided on the second heat accumulation layer 1305.

The switching element 1203 (driving element) is used whether to drive the energy generation elements 111, i.e., to determine the ON/OFF condition. In the ON state, an electric current flows between the source electrode and the drain electrode to drive the energy generation elements 111.

On the liquid discharge head substrate 45, there is provided a flow path wall member 1310 consisting of a cured thermosetting resin such as epoxy resin. The flow path wall member 1310 has the discharge ports 101 provided at the opposing positions of the energy generation elements 111, and the flow path wall 46*a* of the flow path 46 establishing communication between the discharge ports 101 and the ink supply port 102, and it is brought into contact with the liquid discharge head substrate 45 to thereby form the flow path.

The ink supply port 102 extends through the board 1300 from the front surface where the energy generation elements 111 are provided, to the back surface. Ink supplied from the ink supply port 102 is conveyed to the energy generation elements 111 via the ink flow path 46.

By applying a voltage between the VH line and the GNDH line connected to the connection terminals 7, the energy generation elements 111 generate heat, whereby the liquid in the flow path causes film boiling (bubbling). By the pressure of a bubble thus generated, the liquid is discharged from the discharge ports 101, thereby performing recording operation.

Next, the detection lines 114 provided in this liquid discharge head substrate 45 will be described. As illustrated in FIGS. 2B and 3A, the detection lines 114 are provided between the ink supply port 102 and the plurality of energy generation elements 111 with respect to the direction along the surface of the liquid discharge head 41.

As illustrated in FIG. 3B, the detection lines 114 include a first detection line 1314 (other detection line) and a second detection line 1317 (line). Like the logic electrode 1304, the first detection line 1314 is arranged on the first heat accumulation layer 1303, and further, it is covered with the second heat accumulation layer 1305. Like the pair of electrodes 1307, the second detection line 1317 is arranged on the second heat accumulation layer 1305, and further, it is covered with the insulation layer 1308.

With respect to a direction perpendicular to the surface of the board 1300, there is provided on the insulation layer 1308 a protective layer 1309 consisting of a material less subject to dissolution in liquid than the heat accumulation layers and the insulation layer. The protective layer may be formed of the same material as that of the protective layer of the energy generation elements 111. It may be a metal material consisting of a refractory metal such as tantalum, iridium, or ruthenium, or a carbon film (DLC), or a silicon carbide film (SiC) or the like.

Thus, the portion where the first heat accumulation layer 1303, the second heat accumulation layer 1305, and the insulation layer 1308, formed of a silicon compound, are exposed is located in a region 46*b*, which is close to the ink supply port 102.

The upper surface of the insulation layer 1308 is covered with the protective layer 1309, so that it is not subject to dissolution in ink. Therefore, when the flow path is filled with ink, the material of the first heat accumulation layer 1303, the second heat accumulation layer 1305, and the insulation layer 1308 is gradually dissolved first from the region 46*b*.

Thus, before the layers of a silicon compound (the first heat accumulation layer 1303, the second heat accumulation layer 1305, and the insulation layer 1308) around the logic electrodes 1304 (other electrodes) and the pair of electrodes 1307 are dissolved, the layer of a silicon compound around the detection lines 114 is dissolved.

The first detection line 1314 is connected to the connection terminal 7*a*, and the second detection line 1317 is connected to the connection terminal 7*b*. When the first heat accumulation layer 1303 or the second heat accumulation layer 1305 is dissolved in the ink, the ink is brought into contact with the first detection line 1314 before it reaches the logic electrodes 1304.

When dissolution of the second heat generation layer or the insulation layer 1308 in the ink is generated, the ink is brought into contact with the second detection line 1317 before it reaches the pair of electrodes 1307. It is necessary for the material of the detection lines 114 to leak the electric current when brought into contact with ink, so that it is desirable for the material to be a metal material.

With this arrangement, when the ink is brought into contact with the detection lines 114, the electric current flowing through the detection lines 114 leaks, resulting in a change in the value of the electric current flowing between the connection terminals 7.

When there is a change in current value, for example, of 1% or more with respect to a previously measured reference electric current, it is to be determined that there has been generated dissolution in ink of the insulation layer and the heat accumulation layers, which are formed of a material whose main component is silicon.

Through the above detection, it is possible to provide a highly reliable liquid discharge head capable of stopping its use before dissolution/corrosion of the pair of electrodes 1307 and the logic electrodes 1304. Such inspection can be performed, for example, by applying a voltage of 1 to 3 V between the connection terminals 7 while the liquid discharge apparatus main body is in a non-printing state. Further, it is desirable for the inspection to be performed periodically.

Further, by forming the detection lines 114 of a metal material which undergoes corrosion/dissolution through oxidation-reduction reaction by being brought into contact with the ink, it is possible to provide detection lines 114 capable of performing inspection of still higher reliability.

More specifically, examples of the material include aluminum, copper, gold, and an alloy of these metals. By using a material which undergoes corrosion/dissolution through oxidation-reduction reaction to generate a change in resistance value, dissolution/corrosion occurs at the portions brought into contact with the ink, so that the value of the resistance between the connection terminals 7 is changed, resulting in a change in the value of the output electric current.

An example of a change in the value of the electric current in the first detection line and the second detection line, which are formed of a metal material configured to cause oxidation-reduction reaction by being brought into contact with ink, will be described.

An electrode material of a sheet resistance of approximately 30 mΩ/sq (ohm/square) is used for the logic electrodes 1304, an electrode material of a sheet resistance of approximately 60 mΩ/sq (ohm/square) is used for the pair of electrodes 1307, and the first detection line and the second detection line are provided in a width Ws1 of 6 μm. In this case, as illustrated in FIG. 2B, the resistance between the connection terminals 7*a* of the first detection line 1314, which is provided to extend from the connection terminals 7*a* so as to surround the ink supply port 102, is approximately 140 Ω.

The resistance between connection terminals 7*b* of the second detection line 1317, which is provided on the liquid discharge head 41 on the side opposite to the connection terminals 7*a* to extend from the connection terminals 7*b* so as to surround the ink supply port 102, is approximately 280Ω. In this construction, when corrosion is generated in a part (200 μm long and 5.8 μm wide) of the first detection line 1314 and of the second detection line 1317, the resistance of the detection lines increases by approximately 4%, and the value of the output electric current is changed.

Thus, under the influence of both the change in resistance value and leakage, the value of the electric current flowing between the connection terminals 7 is changed greatly, making it possible to perform an inspection of still higher reliability.

In the case where the protective layer 1309 is formed of a metal material, the connection terminals 7 connected to the protective layer 1309 are provided to directly measure the leakage current, whereby it is also possible to detect that dissolution in ink of the insulation layer and the heat accumulation layer, whose main component is silicon, has occurred. When the detection lines 114 are exposed and brought into contact with the ink, an electric current is caused to flow between the connection terminal 7 of the protective layer 1309 and the connection terminals 7 connected to the detection lines 114.

A grounding line used to ground the switching element 1203 and a circuit such as an AND circuit is set to the same potential as the ink potential via the silicon board 1300. Thus, the leakage current can also be measured by measuring the electric current between the connection terminal 7 to which the grounding line is connected and the connection terminal 7 of the detection lines 114, thereby making it possible to detect dissolution.

Further, it is possible to form the first detection line 1314 of the same conductive material such as aluminum (e.g., Al—Si) as the logic electrodes 1304, and to form the second detection line 1317 of the same conductive material such as aluminum (e.g., Al—Cu) as the pair of electrodes 1307.

By thus forming the first detection line 1314 and the logic electrodes 1304 of the same material, and forming the second detection line 1317 and the pair of electrodes 1307 of the same material, it is possible to form them collectively at the time of production, thereby simplifying the production process.

It is also possible to provide the detection lines solely in one of the section between the first heat accumulation layer 1303 and the second heat accumulation layer 1305 and the section between the second heat accumulation layer 1305 and the insulation layer 1308. However, by providing the detection lines in both of these sections, it is possible to detect dissolution with high reliability even in a case where the first heat accumulation layer 1303, the second heat accumulation layer 1305, and the insulation layer 1308 are dissolved in ink at different rates.

Further, by outputting the abnormality detection information to the liquid discharge apparatus (printer) main body side, it is possible to inform the user of an appropriate timing for the replacement of the head.

While, in the first exemplary embodiment, the first detection line 1314 and the second detection line 1317 are respectively connected to a pair of connection terminals 7, in the present exemplary embodiment, detection is effected solely by a pair of connection terminals 7. Otherwise, the present exemplary embodiment is of the same construction and of the same inspection method as the first exemplary embodiment.

Figure 4:
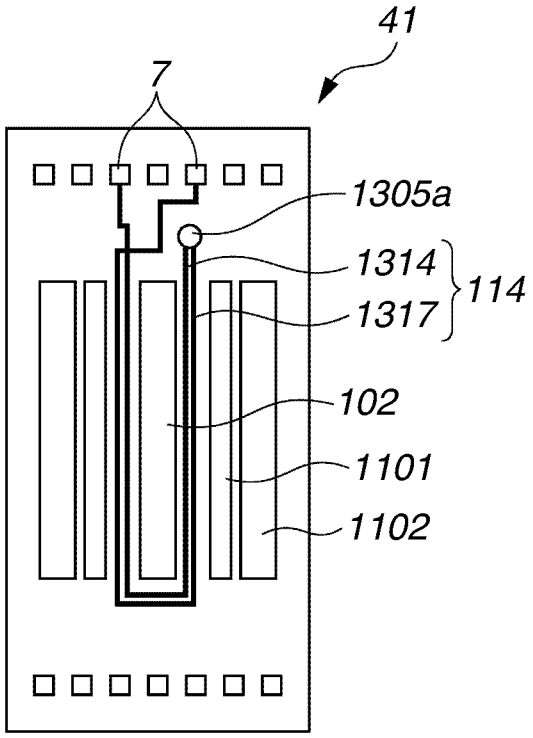
FIG. 4 is a schematic plan view of a liquid discharge head according to an exemplary embodiment of the present invention.

FIG. 4 schematically illustrates the detection lines 114, the ink supply port 102, the element arrays 1101 in which a plurality of energy generation elements 111 are arranged, and the driving element arrays 1102 consisting of a plurality of switching elements of the liquid discharge head 41 of the present exemplary embodiment.

The first detection line 1314 provided on the first heat accumulation layer 1303 and the second detection line 1317 provided on the second heat accumulation layer 1305 are connected via the through-hole 1305*a* of the second heat accumulation layer 1305. By thus connecting the first detection line 1314 and the second detection line 1317, it is possible for only a pair of (two) connection terminals 7 to be used, thereby reducing the substrate area of the liquid discharge head 41.

When the first heat accumulation layer 1303 or the second heat accumulation layer 1305 is dissolved, the ink is brought into contact with the first detection line 1314 before it reaches the logic electrodes 1304. When the second heat accumulation layer or the insulation layer 1308 is dissolved, the ink is brought into contact with the second detection line 1317 before it reaches the pair of electrodes 1307.

By thus performing the inspection with the detection lines, it is possible to detect dissolution of the silicon compound layer, thus making it possible to provide a liquid discharge head of high reliability capable of stopping its use before dissolution/corrosion of the electrodes.

An example of the change in current value in the first detection line and the second detection line, which are formed of a metal material configured to cause oxidation-reduction reaction by coming into contact with the ink, will be described. For example, an electrode material of a sheet resistance of approximately 30 mΩ/sq (ohm/square) is used for the logic electrodes 1304, an electrode material of a sheet resistance of approximately 60 mΩ/sq (ohm/square) is used for the pair of electrodes 1307, and the first detection line and the second detection line are provided in a width Ws2 of 6 μm. In this case, the resistance value between the pair of connection terminals 7 is approximately 420 Ω.

In this case also, when corrosion is generated in a part of the detection lines 114, the resistance value is changed by approximately 4%, so that, as in the first exemplary embodiment, the value of the electric current flowing between the connection terminals 7 is greatly changed under the influence of both the change in resistance value and the leakage, thereby providing an inspection process of still higher reliability.

An arrangement of the detection lines 114 which is different from that of the second exemplary embodiment and in which the number of connection terminal 7 is reduced will be described. This arrangement is of the same construction and of the same inspection method as the first exemplary embodiment.

Figure 5A:
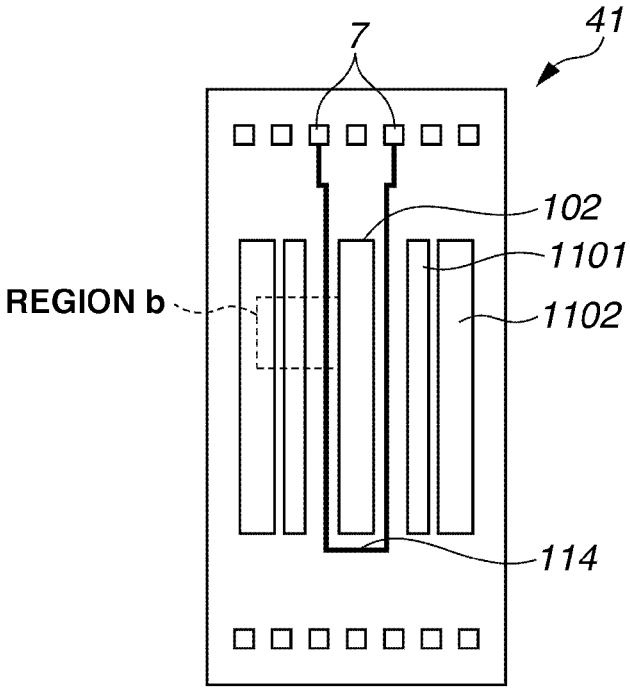
FIGS. 5A, 5B, and 5C are schematic plan views and a sectional view of a liquid discharge head according to an exemplary embodiment of the present invention.
Figure 5B:
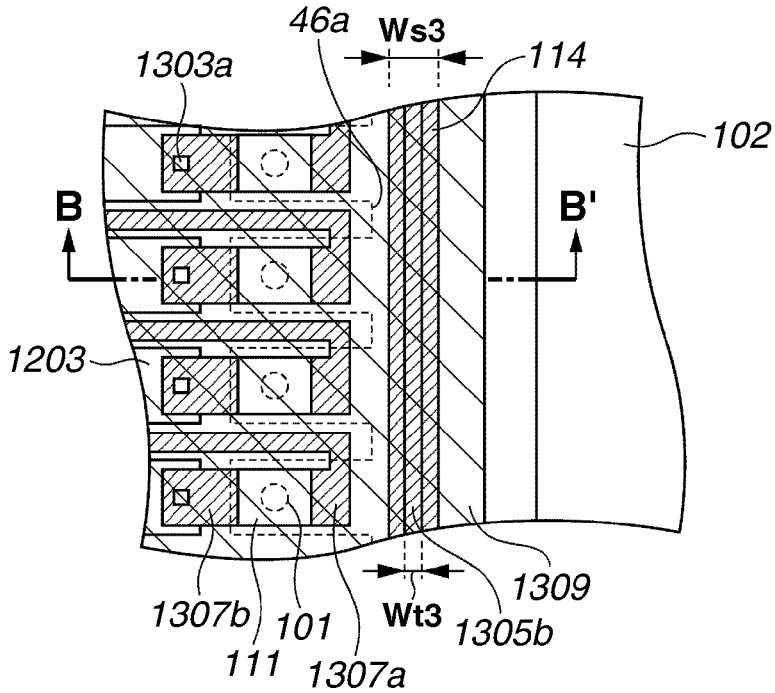
Figure 5C:
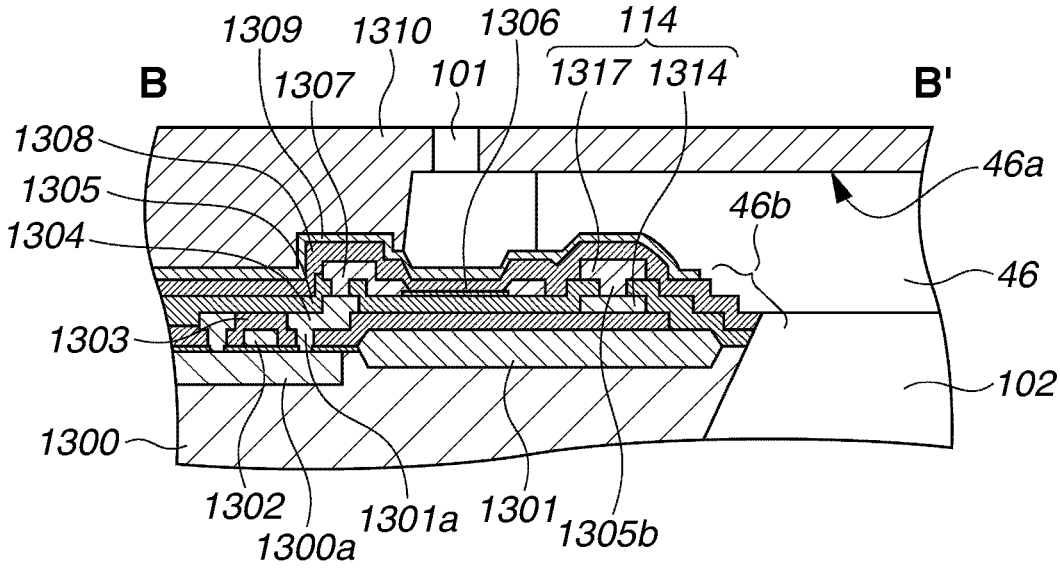

FIG. 5A schematically illustrates the liquid discharge head 41 including the detection lines 114 and the ink supply port 102, the element arrays 1101 in which a plurality of energy generation elements 111 are arranged, and driving element arrays 1102 consisting of a plurality of switching elements. FIG. 5B is an enlarged schematic plan view of the region b of FIG. 5A. FIG. 5C is a sectional view taken along the line B-B' of FIG. 5B.

The first detection line 1314 and the second detection line 1317 are connected to each other via an opening 1305*b* provided in the second heat accumulation layer 1305. The opening 1305*b* is provided so as to extend along the detection line 114 illustrated in FIG. 5A and to surround the ink supply port 102.

The detection lines 114 are provided between the first heat accumulation layer 1303 and the second heat accumulation layer 1305 and between the second heat accumulation layer 1305 and the insulation layer 1308. As a result, it is possible to provide a liquid discharge head of high reliability which enables stopping of its use before dissolution/corrosion of the electrodes even in a case where the layers are dissolved in the ink at different rates.

An example of the change in current value in the first detection line and the second detection line, which are formed of a metal material configured to cause oxidation-reduction reaction by coming into contact with the ink, will be described. For example, an electrode material of a sheet resistance of approximately 30 mΩ/sq (ohm/square) is used for the logic electrodes 1304, an electrode material of a sheet resistance of approximately 60 mΩ/sq (ohm/square) is used for the pair of electrodes 1307, and the first detection line and the second detection line are provided in a width Ws3 of 6 μm, with the width Wt3 of the opening 1305*b* being 2 μm.

In this case, the resistance value between the pair of connection terminals 7 is approximately 90Ω. In this case also, when corrosion is generated in a part of the detection lines 114, the resistance value is changed by approximately 4%, so that, under the influence of both the change in resistance value and the leakage, the value of the electric current flowing between the connection terminals 7 is greatly changed, like in the first exemplary embodiment, thus providing an inspection process of still higher reliability.

Here, another arrangement will be described in which the first detection line 1314 and the second detection line 1317 are connected to each other via the second heat accumulation layer 1305. Otherwise, this arrangement is of the same construction and of the same inspection method as the first exemplary embodiment.

Figure 6A:
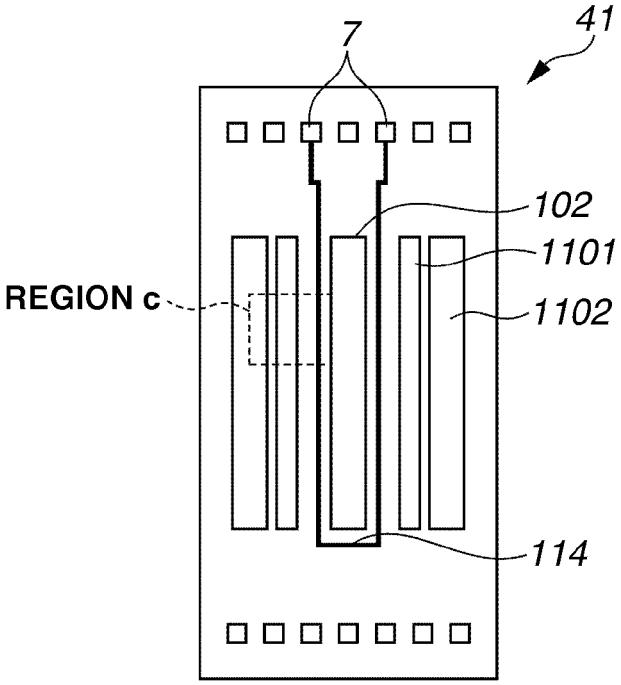
FIGS. 6A, 6B, and 6C are schematic plan views and a sectional view of a liquid discharge head according to an exemplary embodiment of the present invention.
Figure 6B:
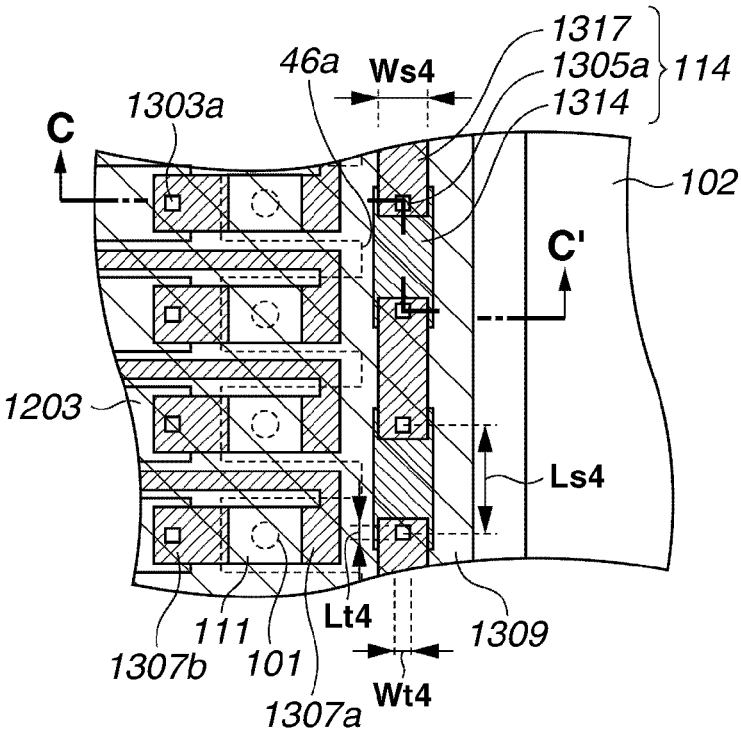
Figure 6C:
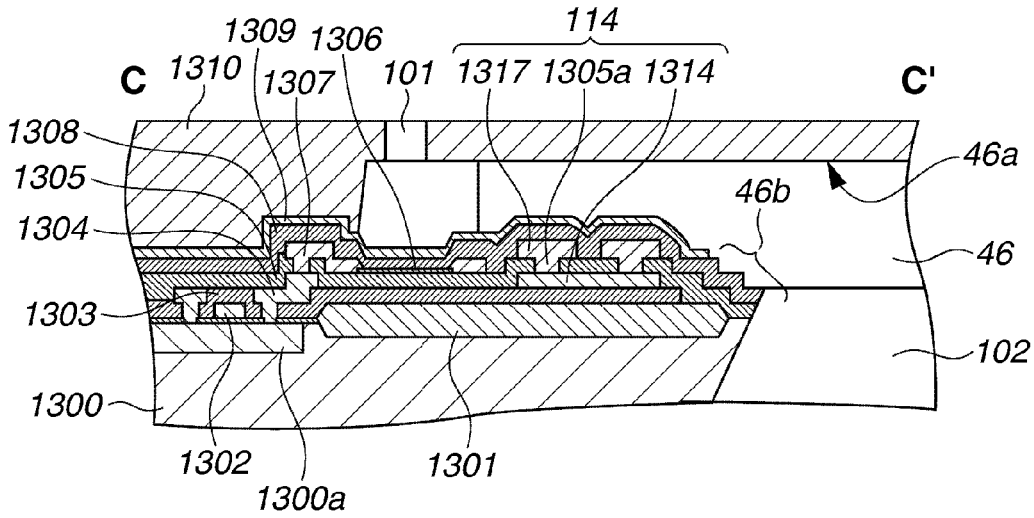

As illustrated in FIG. 6A, the detection lines 114 of the liquid discharge head 41 according to the present exemplary embodiment are connected to the pair of connection terminals 7. FIG. 6B is an enlarged schematic plan view of the region c illustrated in FIG. 6A. FIG. 6C is a sectional view taken along the line C-C' of FIG. 6B.

The detection lines 114 includes a plurality of first detection lines 1314 provided on the first heat accumulation layer 1303 like the logic electrodes 1304 and a plurality of second detection lines 1317 provided on the second heat accumulation layer 1305 like the pair of electrodes 1307. The first detection lines 1314 and the second detection lines 1317 are respectively connected to each other via through-holes 1305*a* of the second heat accumulation layer 1305.

By thus providing the detection lines 114, with the plurality of first detection lines 1314 and the plurality of second detection lines 1317 being alternately connected together, it is possible to reduce the number of connection terminals 7 to two, thereby making it possible to achieve a reduction in the substrate area of the liquid discharge head 41.

There are provided the first detection lines 1314 arranged between the first heat accumulation layer 1303 and the second heat accumulation layer 1305, and the second detection lines 1317 arranged between the second heat accumulation layer 1305 and the insulation layer 1308. As a result, it is possible to provide a highly reliable liquid discharge head capable of stopping its use before dissolution/corrosion of the electrodes even in a case where the first heat accumulation layer 1303, the second heat accumulation layer 1305, and the insulation layer 1308 are dissolved in ink at different dissolution rates.

An example of the change in current value in the first detection lines and the second detection lines, which are formed of a metal material configured to cause oxidation-reduction reaction by coming into contact with the ink, will be described. For example, an electrode material of a sheet resistance of approximately 30 mΩ/sq (ohm/square) is used for the logic electrodes 1304, an electrode material of a sheet resistance of approximately 60 mΩ/sq (ohm/square) is used for the pair of electrodes 1307, and the first detection lines and the second detection lines are provided in a width Ws4 of 6 μm. Further, when the through-holes 1305*a* are provided in a width Wt4=Lt4 of 2 μm, the resistance value between the pair of connection terminals 7 is approximately 210Ω.

In this case also, when corrosion is generated in a part of the detection lines 114, the resistance value is changed by approximately 4%, so that, as in the first exemplary embodiment, under the influence of both the change in resistance value and the leakage, the value of the electric current flowing between the connection terminals 7 is greatly changed, thus providing an inspection process of still higher reliability.

While, in the first exemplary embodiment, one rectangular ink supply port 102 is provided with a plurality of energy generation elements 111, in the present exemplary embodiment, a plurality of rectangular ink supply ports 102 are provided around one energy generation elements 111.

Although the present exemplary embodiment is described using rectangular ink supply ports 102 as an example, the present exemplary embodiment is also applicable to ink supply ports 102 of various configurations such as circular or elliptical ones. In the case of a configuration devoid of corner portions as in the case of a circular or elliptical configuration, it is possible to eliminate stress concentration on the corner portions, thereby making it possible to achieve an improvement in terms of the strength of the substrate. The layer construction of the energy generation element 111 portion and the inspection method are the same as those of the first exemplary embodiment.

Figure 7A:
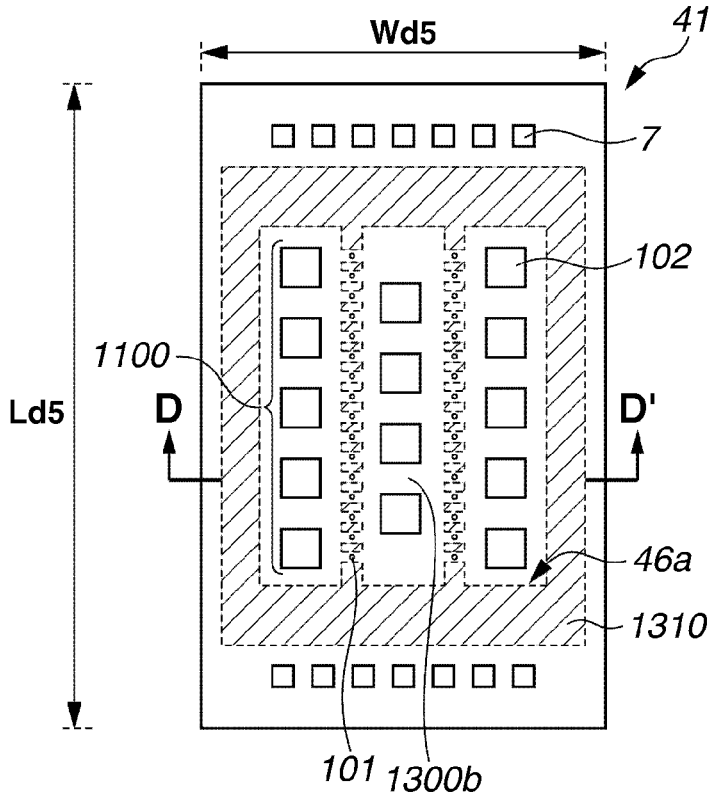
FIGS. 7A, 7B, and 7C are schematic plan views and a sectional view of a liquid discharge head according to an exemplary embodiment of the present invention.

FIG. 7A is a schematic plan view of an example of the liquid discharge head 41, illustrating a wall 46*a* of a flow path wall member 1310, discharge ports 101, three supply port arrays 1100 consisting of ink supply ports 102, and connection terminals 7. For example, the substrate can be provided in a substrate width Wd of 3 mm and a substrate length Ld of 28 mm.

Figure 7B:
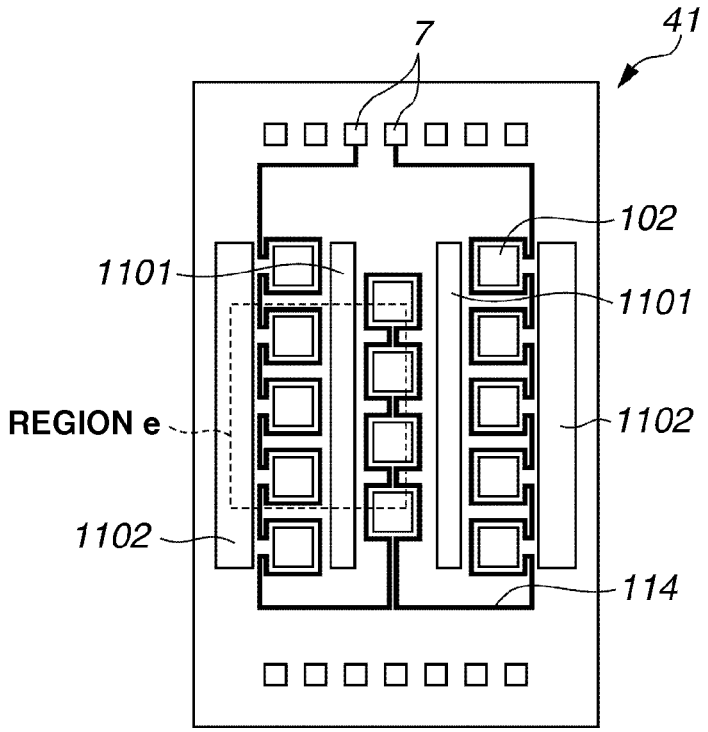

FIG. 7B is a schematic diagram corresponding to FIG. 7A, illustrating the liquid discharge head 41 including the detection lines 114, the three supply port arrays 1100, two element arrays 1101 in which a plurality of energy generation elements 111 are arranged, and driving element arrays 1102 consisting of a plurality of switching elements.

The supply port arrays 1100 are composed of a plurality of ink supply ports 102. The element arrays 1101 are provided so as to be positioned between the supply port arrays 1100. The layer construction of the silicon compound layer, the conductive layer, etc of the energy generation element 111 portion of the liquid discharge head substrate 45 is similar to that of the first exemplary embodiment. The detection lines 114 are connected to a pair of connection terminals 7.

Figure 7C:
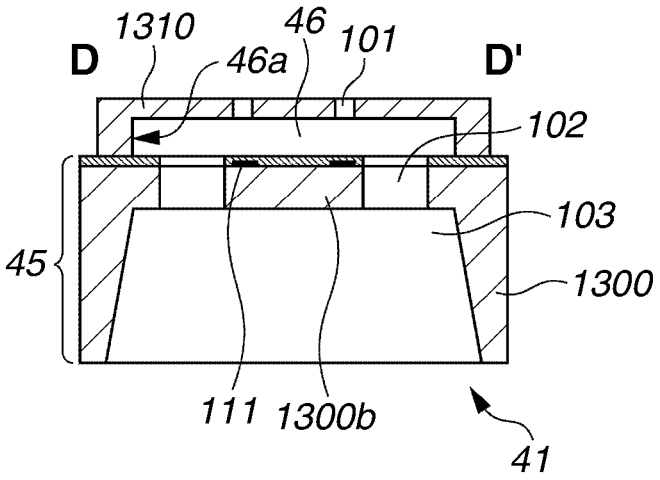

FIG. 7C is a sectional view taken along the line D-D' of FIG. 7A, schematically illustrating the liquid discharge head substrate 45 and the flow path wall member 1310. The plurality of ink supply ports 102 formed individually are provided so as to communicate with a common supply port 103. The ink supplied from an ink tank is sent to the ink supply ports 102 from the common supply port 103, and is conveyed to the energy generation elements 111 by way of the flow path 46.

In this way, by providing the silicon board 1300 with a beam portion 1300*b*, it is possible to enhance the strength of the substrate of the liquid discharge head 41. Further, by providing the electrodes 1307 on the beam portion 1300*b*, it is possible to provide the energy generation elements 111 so as to be surrounded by the ink supply ports 102 without increasing the substrate area.

The common supply port 103 can be formed by an anisotropic etching method using an alkali solution. Further, by using a dry etching method such as the Bosch process, it is possible to provide the individual ink supply ports 102.

Figure 8A:
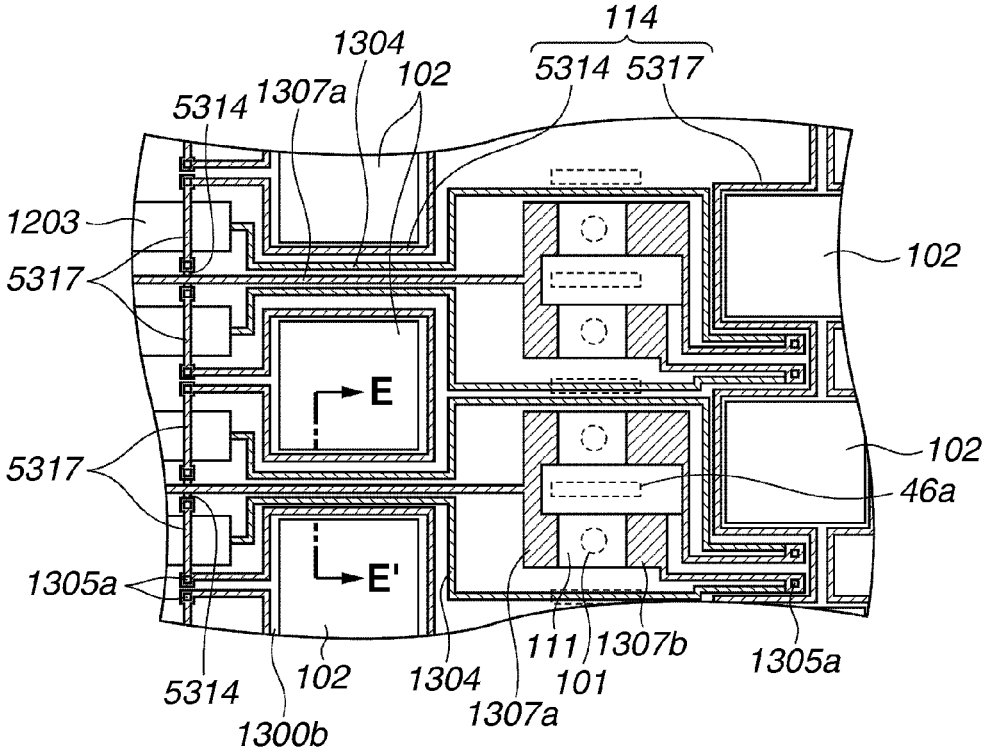
FIGS. 8A, 8B, and 8C are a schematic plan view and sectional views of a liquid discharge head according to an exemplary embodiment of the present invention.

FIG. 8A is an enlarged view of the region e of FIG. 7B. The pair of electrodes 1307 is connected to the energy generation elements 111. Two electrodes are connected as one electrode 1307*a* of the pair of electrodes 1307, passing through the beam portion 1300*b* between the adjacent ink supply ports 102 and extending away from the energy generation elements 111. Further, the electrode 1307*a* is connected to the connection terminals 7 provided at an end portion of the liquid discharge head 41 via a VH line (not illustrated).

The other electrode 1307*b* of the pair of electrodes 1307 is connected to electrodes 1304 (other lines) provided on the first heat accumulation layer 1303 via a through-hole 1305*a* provided in the second heat accumulation layer 1305. The electrodes 1304 pass through the beam portion 1300*b* to be connected to the switching element 1203 as the logic line (drain electrode).

Further, the source electrode side of the switching element 1203 is connected to the connection terminal 7 via a GNDH line (not illustrated) provided on the second heat accumulation layer 1305, etc. On the beam portion 1300*b* of the board 1300 formed of silicon between the adjacent ink supply ports 102, there are provided the electrode 1307*a* formed on the second heat accumulation layer 1305 and the electrode 1304 formed on the first heat accumulation layer 1305.

In FIG. 8A, the discharge ports 101 are provided so as to be positioned at opposing positions of the energy generation elements 111 with respect to a direction perpendicular to the surface of the board 1300. The flow path walls 46*a* of the flow path wall member 1310 are provided between the adjacent energy generation elements 111, and the ink is supplied in line symmetry from the plurality of ink supply ports 102 adjacent to the discharge ports 101.

With this arrangement, the bubble generated through heat generation of the energy generation elements 111 grows in line symmetry inside the flow path 46 to discharge ink, so that it is possible to prevent the ink droplets from being deviated from the target positions. Further, since the ink is supplied from both sides, the ink is supplied in a sufficient amount even when recording operation is performed at high speed, thus making it possible to perform a stable discharge.

Figure 8B:
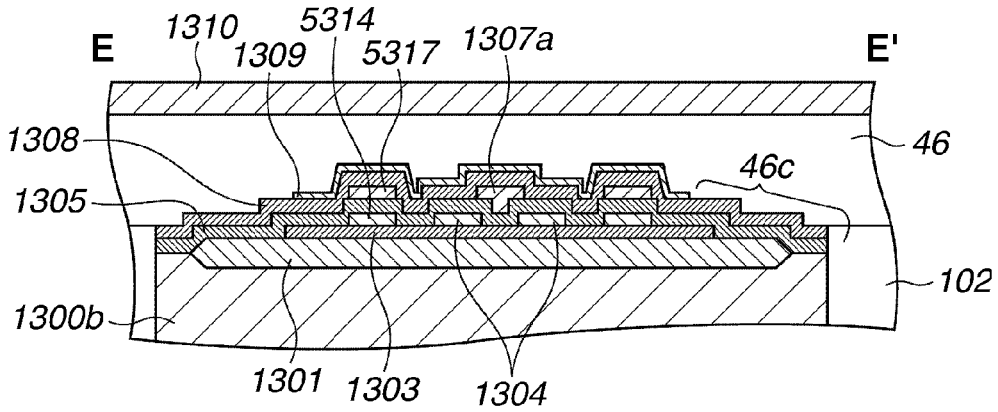

FIG. 8B is a sectional view of the beam portion 1300*b* of the silicon board 1300 of FIG. 8A taken along the line E-E'. On the silicon board 1300, there is provided a thermal oxidation layer 1301 formed through thermal oxidation of the board 1300, and the first heat accumulation layer 1303 (e.g., BPSG) consisting of a silicon compound is formed thereon by using the CVD method or the like.

On the first heat accumulation layer 1303, there is provided the electrode 1304 formed of a conductive material such as aluminum (e.g., Al—Si). Further, the second heat accumulation layer 1305 consisting of a silicon compound (e.g., P—SiO) is provided on the first heat accumulation layer 1303 by using the CVD method or the like so as to cover the electrode 1304.

On the second heat accumulation layer 1305, there is provided an electrode 1307*a* formed of a conductive material such as aluminum (e.g., Al—Cu). Further, the insulation layer 1308 formed of an insulating material consisting of a silicon compound (e.g., SiN) is provided by using the CVD method or the like so as to cover the electrode 1307*a*.

Further, at positions on the insulation layer 1308 corresponding to the upper sides of the electrode 1307*a* and the electrode 1304, there is provided, to prevent dissolution of the insulation layer 1308 in ink, a protective layer 1309 formed of a material less subject to dissolution in liquid than the heat accumulation layers and the insulation layer.

The protective layer may be formed of the same material as the protective layers of the energy generation elements 111. It may be formed of a metal material consisting of a refractory metal such as tantalum, iridium, or ruthenium, or a carbon film (DLC), or a silicon carbide film (SiC) or the like.

Next, the detection lines 114 provided in the above liquid discharge head substrate 45 will be described. As illustrated in FIG. 8A, the detection lines 114, which consist of a first detection line 5314 and a second detection line 5317, are provided between the ink supply ports 102, the electrode 1307*a*, and the electrode 1304 so as to surround the ink supply ports 102.

Around the ink supply ports 102, the detection lines 114 are provided so as to surround the ink supply ports 102, with the first detection line 5314 and the second detection line 5317 being laminated.

The first detection line 5314 is provided on the first heat accumulation layer 1303 like the electrode 1304 connected to the switching elements 1203, and is, further, covered with the second heat accumulation layer 1305. The second detection line 5317 is arranged on the second heat accumulation layer 1305 like the electrode 1307*a*, and is covered with the insulation layer 1308.

Further, also on the upper side of the first detection line 5314 and the second detection line 5317, there is provided a protective layer 1309 excellent in resistance to ink to prevent dissolution of the insulation layer 1308 in ink. Thus, the portion where the first heat accumulation layer 1303, the second heat accumulation layer 1305, and the insulation layer 1308, which are formed of a material consisting of a silicon compound, is located in a region 46*c* close to the ink supply ports 102.

Since it is covered with the protective layer 1309, the insulation layer 1308 is not easily dissolved in ink, so that, when the flow path is filled with ink, the material of the first heat accumulation layer 1303, the second heat accumulation layer 1305, and the insulation layer 1308 is gradually dissolved from the region 46*c*. Thus, before the electrode 1304 and the first heat accumulation layer 1303, the second heat accumulation layer 1305, and the insulation layer 1308 around the electrode 1307*a* are dissolved, the first heat accumulation layer 1303, the second heat accumulation layer 1305, and the insulation layer 1308 around the detection lines 114 are dissolved.

The portion connecting the adjacent ink supply ports 102 is formed solely by the second detection line 5317 on the upper side of the switching elements 1203 and solely by the first detection line 5314 in the portion where the electrodes 1307*b* are provided. The first detection line 5314 and the second detection line 5317 forming the above portion are connected via through-holes 1305*a* provided in the second heat accumulation layer 1305.

When the first heat accumulation layer 1303 or the second heat accumulation layer 1305 is dissolved in ink, the ink is brought into contact with the first detection line 5314 before it reaches the electrode 1304, and, when the second heat accumulation layer or the insulation layer 1308 is dissolved, the ink is brought into contact with the second detection line 5317 before it reaches the electrodes 1307*a*.

In this way, inspection operation is conducted with the detection lines provided, whereby it is possible to detect dissolution of the layers formed of a silicon compound, thus making it possible to provide a highly reliable liquid discharge head capable of stopping its use before dissolution/corrosion of the electrodes.

Also in the present exemplary embodiment, the detection lines 114 are formed of a metal material configured to cause oxidation-reduction reaction by being brought into contact with ink to be corroded/dissolved to cause a change in the resistance value, whereby it is possible to further enhance the reliability of the detection lines 114. More specifically, examples of the metal material include aluminum, copper, gold, and an alloy of these metals. With the use of a metal material configured to cause oxidation-reduction reaction to be corroded/dissolved to cause a change in resistance value, dissolution/corrosion occurs where it is brought into contact with the ink, so that the resistance value between the connection terminals 7 changes, resulting in a change in the value of the electric current output.

Further, it is possible to form the first detection line 5314 of the same conductive material as the electrodes 1304, i.e., aluminum or the like (e.g., Al—Si), and to form the second detection lie 5317 of the same conductive material as the electrodes 1307*a*, i.e., aluminum or the like (e.g., Al—Cu). By thus forming the first detection line 5314 and the electrodes 1304 of the same material, and forming the second detection line 5317 and the electrodes 1307*a* of the same material, it is possible to form them collectively at the time of production, thereby simplifying the production process.

It is also possible to provide the detection lines only one of the section between the first heat accumulation layer 1303 and the second heat accumulation layer 1305, and the section between the second heat accumulation layer 1305 and the insulation layer 1308. However, by providing the detection lines in both the sections, it is possible to detect dissolution with high reliability even in a case where the first heat accumulation layer 1303, the second heat accumulation layer 1305, and the insulation layer 1308 are dissolved in ink at different rates.

Figure 8C:
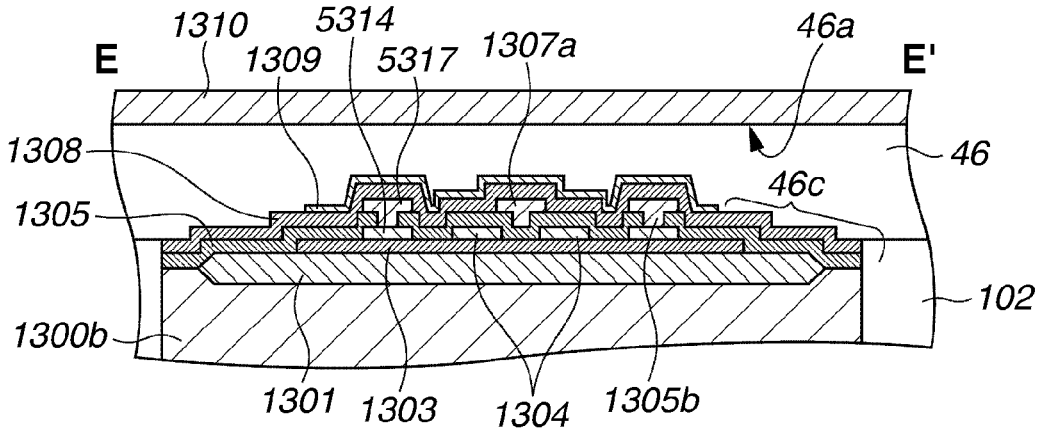

Further, as in a third exemplary embodiment, it is also possible to provide the openings 1305*b* connecting the first detection line 5314 and the second detection line 5317 to the second heat accumulation layer 1305 so as to surround the ink supply ports 102 as illustrated in FIG. 8C.

In this way, it is possible to enlarge the sectional area of the detection lines 114 and to reduce the resistance value between the connection terminals 7. When the reference resistance value is reduced, the change in resistance value due to corrosion from contact with ink becomes conspicuous, so that, in the construction in which a metal material configured to cause oxidation-reduction reaction is adopted, it is possible to detect with higher sensitivity dissolution in ink of the protective layer, the heat accumulation layers, etc.

Further, the surfaces of the ink supply ports 102 provided by using the dry etching method is not of the surface orientation (111), so that dissolution in liquid occurs more easily than in the case of ink supply ports provided by anisotropic etching. However, by providing the detection lines 114 as described above, it is possible to detect even if the board 1300 is dissolved in addition to the heat accumulation layers and the insulation layer.

Further, it is necessary to reduce the substrate area and to perform the supply of liquid to a sufficient degree, so that, in the form in which a plurality of supply ports 102 are provided, the width of the independent beam portions 1300*b*, that is, the distance between the electrodes and the flow path, is small, resulting in a strong risk of the electrodes being brought into contact with the liquid. By providing the detection lines 114 as described above, it is possible to enhance detection reliably, thus making it possible to provide a liquid discharge head of high reliability.

A fifth exemplary embodiment provides another construction of the detection lines 114 provided in the beam portions 1300*b* of a liquid discharge head 41. The layer construction of the energy generation element 111 portion and the inspection method are the same as those of the first exemplary embodiment, and the arrangement of the plurality of ink supply port arrays and energy generation elements 111 are the same as those of the fifth exemplary embodiment.

Figure 9A:
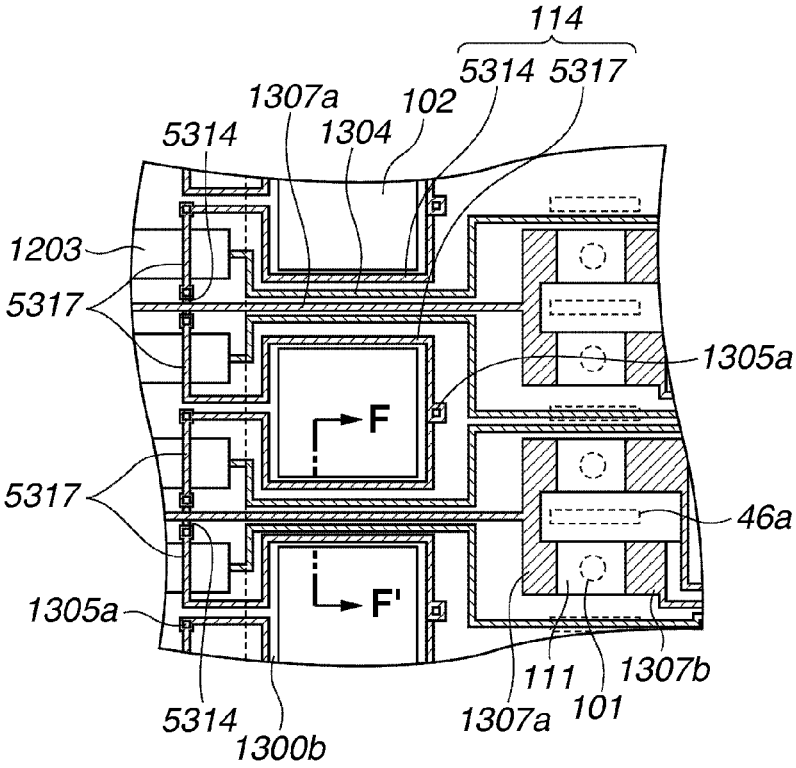
FIGS. 9A and 9B are a schematic plan view and a sectional view of a liquid discharge head according to an exemplary embodiment of the present invention.
Figure 9B:
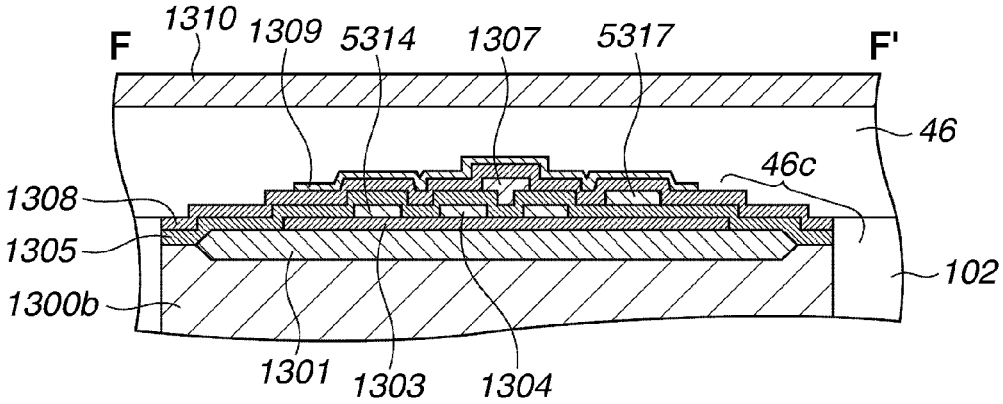

FIG. 9A is an enlarged view of the region e of FIG. 7B. FIG. 9B is a sectional view taken along the line F-F' of FIG. 9A.

In the present exemplary embodiment, the detection lines 114 surrounding the ink supply ports 102 are provided such that portions consisting solely of the first detection line 5314 and portions consisting solely of the second detection line 5317 are alternately connected together by through-holes 1305*a* provided in the second heat accumulation layer 1305.

When the first heat accumulation layer 1303 or the second heat accumulation layer 1305 is dissolved in ink, the ink is brought into contact with the first detection line 5314 before it reaches the electrodes 1304, and when the second heat accumulation layer or the insulation layer 1308 is dissolved, the ink is brought into contact with the second detection line 5317 before it reaches the electrodes 1307*a*. In this way, inspection operation is conducted with the provided detection lines, whereby it is possible to detect dissolution of the layers of a silicon compound, thus making it possible to provide a highly reliable liquid discharge head capable of stopping its use before dissolution/corrosion of the electrodes.

While in the fifth exemplary embodiment and the sixth exemplary embodiment the electrodes for supplying power to the energy generation elements 111 are provided in two layers in the beam portions 1300*b*, in the present exemplary embodiment described below, the electrodes are provided in one layer. The layer construction of the portion near the energy generation elements 111 and the inspection method are the same as those of the first exemplary embodiment, so that a description thereof will be omitted. The following description will center on the differences from the fifth exemplary embodiment.

Figure 10A:
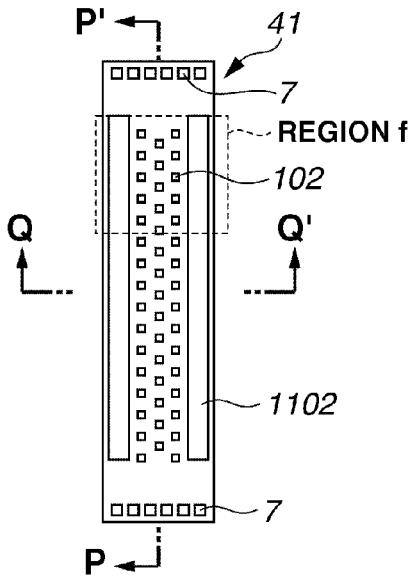
FIGS. 10A, 10B, and 10C are schematic plan views and a sectional view of a liquid discharge head according to an exemplary embodiment of the present invention.
Figure 10B:
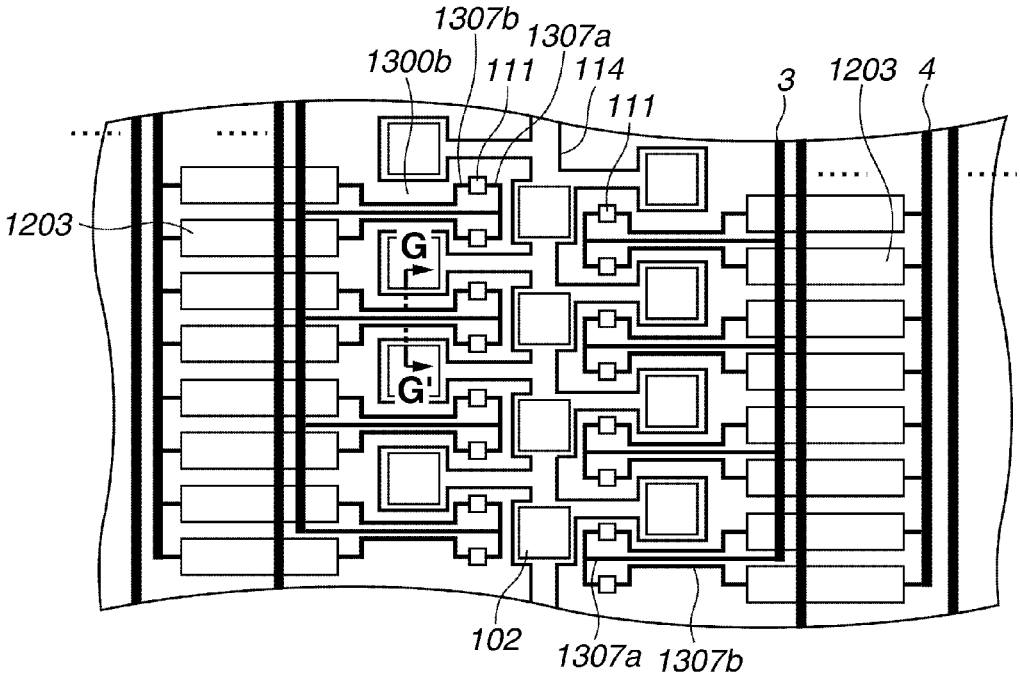

FIG. 10A is a schematic diagram illustrating a liquid discharge head 41 including a plurality of ink supply ports 102, driving element arrays 1102 consisting of a plurality of switching elements 1203, and connection terminals 7. FIG. 10B is an enlarged view of the region f of FIG. 10A.

A pair of electrodes 1307 supplying electricity is connected to an energy generation element 111. As one electrode 1307*a* of the pair of electrodes 1307, there are connected two electrodes, passing between a beam portion 1300*b* between the adjacent ink supply port 102 to extend away from the energy generation element 111. Further, the electrode 1307*a* is connected to the connection terminal 7 provided at an end portion of the liquid discharge head 41 via a VH line 3 provided on the upper side of the switching elements 1203.

Also the other electrode 1307*b* of the pair of electrodes 1307 passes through the beam portion 1300*b* between the adjacent ink supply ports 102 to extend away from the energy generation element 111. It is connected to the switching element 1203 as a logic line (drain electrode). Further, the source electrode of the switching element 1203 is connected to the connection terminals 7 via a GNDH line.

Figure 10C:
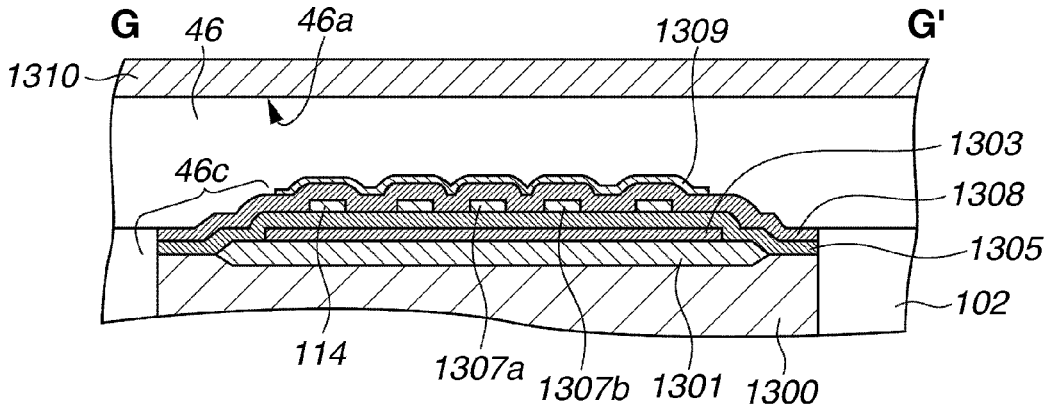

FIG. 10C is a sectional view taken along the line G-G' of FIG. 10B. On the silicon board 1300, there is provided a thermal oxidation layer 1301 through thermal oxidation of the board 1300, and a first heat accumulation layer 1303 consisting of a silicon compound (e.g., BPSG) is provided by using the CVD method or the like.

On the first heat accumulation layer 1303, there is provided a second heat accumulation layer 1305 consisting of a silicon compound (e.g., P—SiO) by using the CVD method or the like. On the second heat accumulation layer 1305, there is provided a pair of electrodes 1307 (first electrode 1307*a* and second electrode 1307*b*) consisting of a conductive material such as aluminum (e.g., Al—Cu) are provided.

Further, by using the CVD method or the like, there is provided an insulation layer 1308 formed of an insulating material consisting of a silicon compound (e.g., SiN) so as to cover the pair of electrodes 1307. Further, on the insulation layer 1308 corresponding to the upper side of the electrode 1307, there is provided, to prevent dissolution in ink of the insulation layer 1308, a protective layer 1309 formed of a material less subject to dissolution in liquid than the heat accumulation layers and the insulation layer.

The protective layer may be formed of the same material as the protective layer of the energy generation elements 111, and it may be formed of a metal material consisting of a refractory metal such as tantalum, iridium, or ruthenium, or a carbon film (DLC), or a silicon carbide film (SiC) or the like.

Next, detection lines 114 provided on the liquid discharge head substrate 45 will be described. As illustrated in FIG. 10B, the detection lines 114 are provided between the ink supply ports 102 and the pair of electrodes 1307 so as to surround the ink supply ports 102, and are connected to the connection terminals 7. As illustrated in FIG. 10C, like the pair of electrodes 1307, the detection lines 114 are provided on the second heat accumulation layer 1305, and is further covered with the insulation layer 1308.

Also on the upper side of the detection lines 114, there is provided a protective layer 1309 excellent in resistance to ink to prevent dissolution of the insulation layer 1308 in ink. Thus, the portion where the first heat accumulation layer 1303, the second heat accumulation layer 1305, and the insulation layer 1308 are exposed is located in a region 46*c* close to the ink supply ports 102.

Since it is covered with the protective layer 1309, the insulation layer 1308 is not easily dissolved in ink, so that when the flow path is filled with ink, the material of the first accumulation layer 1303, the second heat accumulation layer 1305, and the insulation layer 1308 is gradually dissolved starting from the region 46*c*.

Thus, before the second heat accumulation layer 1305 and the insulation layer 1308 covering the electrodes 1307 are dissolved, the portion of the second heat accumulation layer 1305 and the insulation layer 1308 around the detection lines 114 is dissolved. As a result, the ink is brought into contact with the detection lines 114 before it reaches the electrodes 1307*a*, thus making it possible to detect the dissolution of the silicon compound layer.

In this way, inspection operation is conducted with the provided detection lines, whereby it is possible to provide a highly reliable liquid discharge head capable of stopping its use before dissolution/corrosion of the electrodes 1307.

In the constructions of the first through seventh exemplary embodiments described above, in which a plurality of ink supply ports 102 are provided by using the dry etching method, the detection lines 114 are provided so as to surround all the ink supply ports 102. However, dissolution in ink of the layers formed of a silicon compound does not occur locally but uniformly to a certain degree of expansion.

In view of this, as in the present exemplary embodiment, it is also possible to detect dissolution with high reliability by providing the detection lines 114 solely in a part of the plurality of ink supply ports 102. The layer construction of the energy generation element portion 111 and the inspection method adopted are the same as those in the first exemplary embodiment, so that a description thereof will be omitted. Further, the sectional configuration of the detection lines 114 may be that of any of the fifth through seventh exemplary embodiments described above.

In a dry etching technique such as the Bosch process used to form the ink supply ports 102, there is involved a phenomenon called tilting, in which the etching is obliquely deviated. By way of example, the Bosch process will be described, which is a reactive ion etching (deep etching) of high aspect ratio used to process a silicon board.

The Bosch process includes a protection step in which a protective layer is provided on a side wall to suppress etching in the lateral direction, and an etching step in which anisotropic etching is performed radially on the silicon board. In the etching step, etching is performed with the entire surface charged negatively. Thus, if there is any negatively charged surface near the processed portion, the ion advancing direction is deflected, resulting in generation of a region where the etching position is deviated (tilting phenomenon).

Figure 11A:
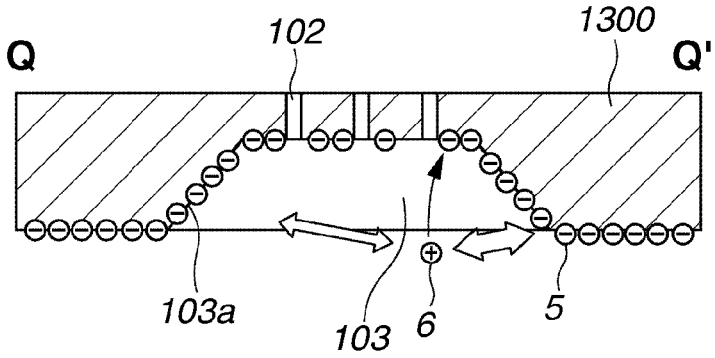
FIGS. 11A, 11B, and 11C are sectional views and a plan view of a liquid discharge head according to an exemplary embodiment of the present invention.
Figure 11B:
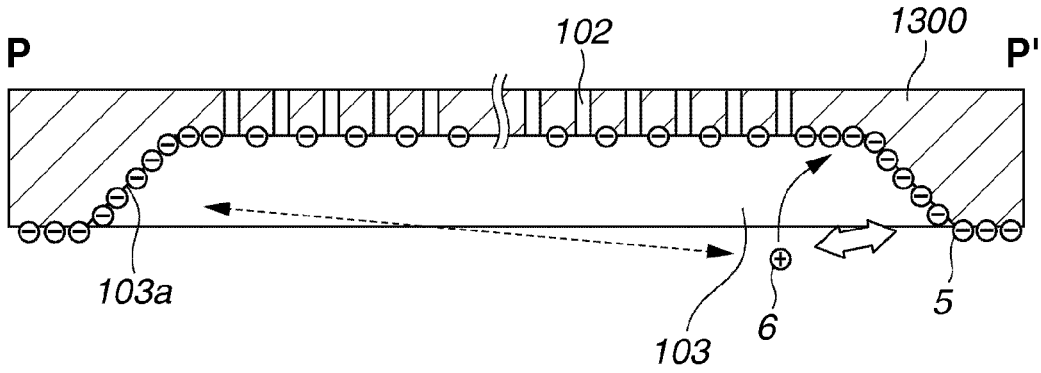

FIG. 11A is a sectional vie of the liquid discharge head 41 taken along the line Q-Q' of FIG. 10A, and FIG. 11B is a sectional view of the same taken along the line P-P'. The ink supply ports 102 are formed by using the Bosh process after providing a common supply port 103 by anisotropic etching in an alkali solution, so that the wall surface 103*a* of the board 1300 is an inclined surface inclined by approximately 54.7 degrees.

As illustrated in FIGS. 11A and 11B, the ions used for etching receive a force from the right-hand side inclined surface and the left-hand side inclined surface charged with negative electric charge 5, and depending on the etching position, undergo bending of their path. Thus, while the ink supply ports 102 in the central portion are formed vertically, the ink supply ports 102 near the inclined surfaces are formed in a distorted configuration or are deviated from the desired positions (design positions).

This phenomenon is particularly conspicuous in the direction of the P-P' sectional surface (the longitudinal direction of the substrate). This is due to the fact that the distance between the opposing inclined surfaces is long in the direction of the P-P' sectional surface, so that, in the regions close to the inclined surfaces, the force is only applied to one inclined surface, resulting in great bending of the path of the ions 6. That is, the positions of the ink supply ports 102 in the vicinity of the longitudinal ends of the liquid discharge head 41 are the most subject to deviation from the design positions, and are likely to cause exposure of the electrodes. Thus, the detection lines 114 are provided at positions close to the ink supply ports 102 (flow path), and the regions are more subject to exposure as compared with the other regions.

Figure 11C:
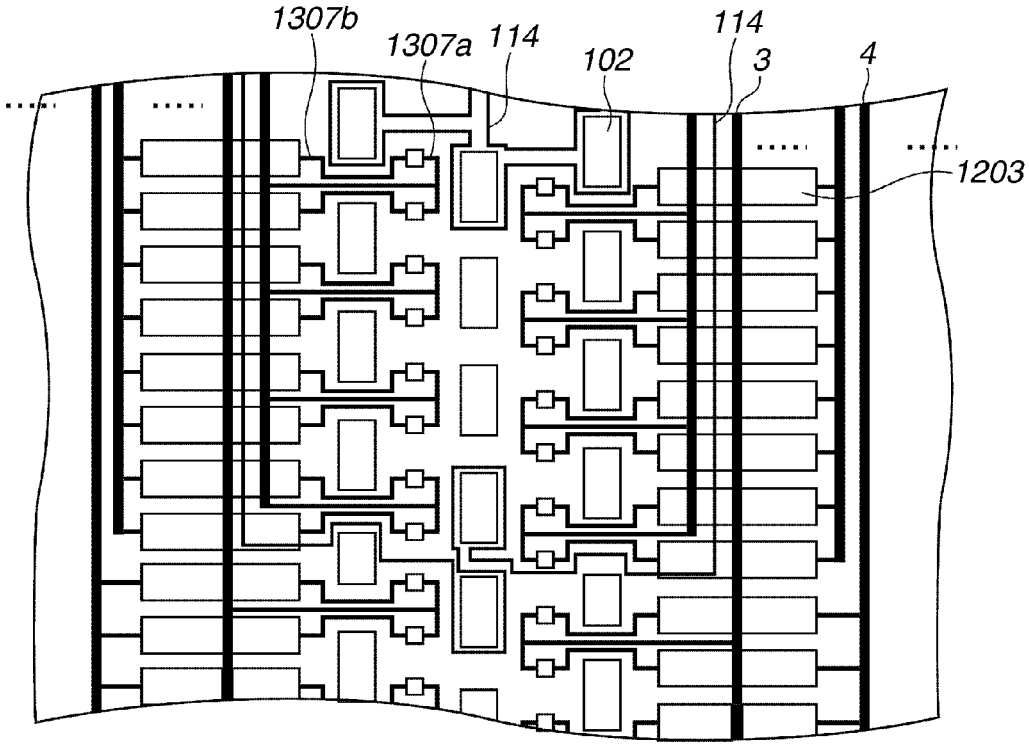

Thus, by providing the detection lines 114 solely in these regions at the substrate end portions, it is possible to secure reliability for the entire surface of the liquid discharge head 41. As illustrated in FIG. 11C, which is an enlarged view of the region f of FIG. 10A, in addition to the portions near the end portions of the substrate, detection lines may be provided in other portions as appropriate, whereby it is possible to secure reliability for the liquid discharge head 41.

By thus providing the detection lines 114 solely in a part of the plurality of in supply ports 102, it is possible to reduce the substrate area, thereby achieving a reduction in cost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-139956 filed Jun. 18, 2010, which is hereby incorporated by reference herein in its entirety.

What is claimed is:

1. A liquid discharge head comprising:

a liquid discharge head substrate having a board provided with a supply port on a surface of the board to supply a liquid, a silicon compound layer including a silicon compound provided on the surface of the board, an energy generation element configured to generate energy to discharge the liquid from a discharge port and including a heat generation resistor layer provided on the silicon compound layer and formed of a material configured to generate heat through supply of electricity and a pair of electrodes connected to the heat generation resistor layer, and an insulation layer including a silicon compound and provided so as to cover the energy generation element;

a flow path wall member having a wall of a flow path establishing communication between the discharge port and the supply port and configured to form the flow path by being placed into contact with the liquid discharge head substrate; and a line formed of a metal material, electrically connected to a pair of terminals on the board, provided between the silicon compound layer and the insulation layer, and used for detecting dissolution of at least one of the silicon compound layer and the insulation layer, at least a portion of the line being provided between the supply port and the energy generation element when viewed from a direction perpendicular to the surface of the board.

2. The liquid discharge head according to claim 1, wherein the metal material of the line is a material configured to cause an oxidation-reduction reaction by contacting with the liquid.

3. The liquid discharge head according to claim 1, wherein the metal material of the line is aluminum, copper, gold, or an alloy thereof.

4. The liquid discharge head according to claim 1, wherein the material of the pair of electrodes and the metal material of the line include the same material.

5. The liquid discharge head according to claim 1, further comprising a protective layer formed of a material less subject to dissolution in the liquid than the silicon compound layer and the insulation layer and provided on the insulation layer corresponding to the upper side of the line.

6. The liquid discharge head according to claim 5, wherein the protective layer is formed of one of tantalum, iridium, ruthenium, a carbon film (DLC), and a silicon carbide film (SiC).

7. The liquid discharge head according to claim 1, wherein the silicon compound layer and the insulation layer are formed using the CVD method.

8. The liquid discharge head according to claim 1, wherein when at least one of the silicon compound layer and the insulation layer is dissolved and the line is exposed in the flow path, a value of an electric current flowing between the pair of terminals is changed.

9. The liquid discharge head according to claim 1, wherein the silicon compound layer includes a first silicon compound layer provided on the board and a second silicon compound layer provided on the first silicon compound layer, wherein, between the first silicon compound layer and the second silicon compound layer, another electrode connected to a driving element for determining whether or not to drive the energy generation element is provided, and wherein another line formed of a metal material, electrically connected to a pair of terminals provided on the board, is provided between the first silicon compound layer and the second silicon compound layer, and used for detecting dissolution of at least one of the first silicon compound layer and the second silicon compound layer, at least a portion of the other line being provided between the supply port and the other electrode when viewed from the perpendicular direction.

10. The liquid discharge head according to claim 9, wherein the line and the other line are connected via a through-hole arranged in the second silicon compound layer.

11. The liquid discharge head according to claim 9, wherein the metal material of the other line is a material configured to cause oxidation-reduction reaction by contacting with the liquid.

12. The liquid discharge head according to claim 9, wherein the metal material of the other line is aluminum, copper, gold, or an alloy thereof.

13. The liquid discharge head according to claim 9, wherein the material of the other electrode and the metal material of the other line include the same material.

14. The liquid discharge head according to claim 9, further comprising a protective layer formed of a material less subject to dissolution in the liquid than the silicon compound layer and the insulation layer on the insulation layer corresponding to the upper side of the other line.

15. The liquid discharge head according to claim 1, wherein the board has a plurality of supply port arrays in which a plurality of supply ports are arranged, and wherein, between the supply port arrays, an element array in which a plurality of energy generation elements are arranged is provided.

16. The liquid discharge head according to claim 1, wherein the dissolution of at least one of the silicon compound layer and the insulation layer is detected by a change of a value of an electric current flowing between the pair of terminals.

17. The liquid discharge head according to claim 1, further comprising:

a plurality of the supply ports on the surface of the board; and another electrode electrically connected to at least one of the pair of electrodes, provided between adjacent supply ports of the supply ports when viewed from the perpendicular direction, wherein the line is provided between the supply port and the other electrode when viewed from the perpendicular direction.

18. The liquid discharge head according to claim 17, wherein a plurality of the energy generation elements are arranged in a direction in which the plurality of the supply ports are arranged.

19. The liquid discharge head according to claim 1, wherein the line contacts the silicon compound layer and the insulation layer.

20. A liquid discharge head substrate comprising:

a board provided with a supply port on a surface of the board to supply a liquid;

a silicon compound layer including a silicon compound provided on the surface of the board;

an energy generation element configured to generate energy to discharge the liquid from a discharge port and including a heat generation resistor layer provided on the silicon compound layer and formed of a material configured to generate heat through supply of electricity and a pair of electrodes connected to the heat generation resistor layer;

an insulation layer including a silicon compound and provided so as to cover the energy generation element; and a line formed of a metal material, electrically connected to a pair of terminals provided on the board, provided between the silicon compound layer and the insulation layer, and used for detecting dissolution of at least one of the silicon compound layer and the insulation layer, at least a portion of the line being provided between the supply port and the energy generation element when viewed from a direction perpendicular to the surface of the board.

* * * * *